US011851297B2

(12) United States Patent
Harigae et al.

(10) Patent No.: US 11,851,297 B2
(45) Date of Patent: Dec. 26, 2023

(54) FEEDING APPARATUS, PRINTING APPARATUS, AND CONTROL METHOD OF FEEDING APPARATUS

(71) Applicant: CANON KABUSHIKI KAISHA, Tokyo (JP)

(72) Inventors: Ryo Harigae, Tokyo (JP); Kenji Shimamura, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 412 days.

(21) Appl. No.: 17/197,433

(22) Filed: Mar. 10, 2021

(65) Prior Publication Data

US 2021/0284476 A1 Sep. 16, 2021

(30) Foreign Application Priority Data

Mar. 12, 2020 (JP) ..... 2020-043332

(51) Int. Cl.

| | |
|---|---|
| ***B65H 23/16*** | (2006.01) |
| ***B41J 15/16*** | (2006.01) |
| ***B65H 23/00*** | (2006.01) |

(52) U.S. Cl.

CPC ..... *B65H 23/16* (2013.01); *B41J 15/16* (2013.01); *B65H 23/005* (2013.01)

(58) Field of Classification Search

None

See application file for complete search history.

(56) References Cited

U.S. PATENT DOCUMENTS

| | | | | |
|---|---|---|---|---|
| 5,249,754 | A * | 10/1993 | Liermann | G03B 1/58 242/562 |
| 9,969,192 | B2 | 5/2018 | Suzuki et al. | |
| 10,434,800 | B1 * | 10/2019 | Colonel | B65H 19/105 |
| 10,752,458 | B2 * | 8/2020 | Wind | B65H 16/028 |
| 10,807,822 | B2 * | 10/2020 | Yamaya | B65H 19/10 |
| 10,906,764 | B2 * | 2/2021 | Yoneyama | B65H 16/10 |
| 11,560,000 | B2 * | 1/2023 | Suto | B41J 15/042 |
| 2009/0236463 | A1 * | 9/2009 | Izumida | B65H 23/038 242/547 |
| 2018/0281481 | A1 * | 10/2018 | Yamaya | B41J 13/26 |
| 2018/0282085 | A1 * | 10/2018 | Kinoshita | B65H 9/006 |
| 2021/0284475 | A1 * | 9/2021 | Shimamura | B65H 19/105 |
| 2022/0355599 | A1 * | 11/2022 | Hirama | B41J 11/70 |
| 2023/0136467 | A1 * | 5/2023 | Vogt | B23K 26/032 347/264 |

FOREIGN PATENT DOCUMENTS

| | | |
|---|---|---|
| JP | 2005-060017 A | 3/2005 |

* cited by examiner

*Primary Examiner* — William A. Rivera
(74) *Attorney, Agent, or Firm* — Venable LLP

(57) ABSTRACT

An apparatus includes a first drive unit configured to rotate a roll sheet supported by a roll support unit in a predetermined rotation direction to feed the sheet into a conveyance path, an abutment portion provided so as to be capable of abutting against an outer peripheral surface of the roll sheet at a first position, and a rotation member provided so as to be capable of abutting against the outer peripheral surface at a second position. The first drive unit rotates the roll sheet in the direction to introduce, into the conveyance path, a leading edge of the sheet having passed between the first and second positions. The apparatus further includes a second drive unit configured to rotate the rotation member in a direction in which a slack of the sheet is formed between the first and second positions.

14 Claims, 16 Drawing Sheets

FEEDING APPARATUS, PRINTING APPARATUS, AND CONTROL METHOD OF FEEDING APPARATUS

BACKGROUND OF THE INVENTION

Field of the Invention

The present invention relates to a feeding technique of a roll sheet.

Description of the Related Art

In order to reduce the user's labor upon pulling out a sheet from a roll sheet and introducing it into the apparatus, there has been proposed a technique that automates part of the feeding operation. Japanese Patent Laid-Open No. 2005-60017 discloses an apparatus that rotates a roll sheet in a sheet feeding direction when it is detected that the leading edge of the roll sheet is separated from the outer peripheral surface of the roll sheet by its own weight.

The method by the apparatus disclosed in Japanese Patent Laid-Open No. 2005-60017 cannot be applied to a case in which the sheet is conveyed into a conveyance path from a direction in which the leading edge of the sheet is difficult to be separated from the roll sheet by its own weight.

SUMMARY OF THE INVENTION

The present invention provides a technique that can more reliably introduce the leading edge of a roll sheet into a conveyance path.

According to an aspect of the present invention, there is provided a feeding apparatus comprising a roll support unit configured to rotatably support a roll sheet which is a sheet wound into a roll form, a first drive unit configured to rotate the roll sheet supported by the roll support unit in a predetermined rotation direction to feed the sheet into a conveyance path, an abutment portion provided so as to be capable of abutting against an outer peripheral surface of the roll sheet at a first position, and a rotation member provided so as to be capable of abutting against the outer peripheral surface at a second position different from the first position, wherein the first drive unit rotates the roll sheet in the predetermined rotation direction to introduce, into the conveyance path, a leading edge of the sheet having passed between the first position and the second position, and the apparatus further comprises a second drive unit configured to rotate the rotation member in a direction in which a slack of the sheet is formed between the first position and the second position.

Further features of the present invention will become apparent from the following description of exemplary embodiments (with reference to the attached drawings).

DESCRIPTION OF THE EMBODIMENTS

Figure 1:
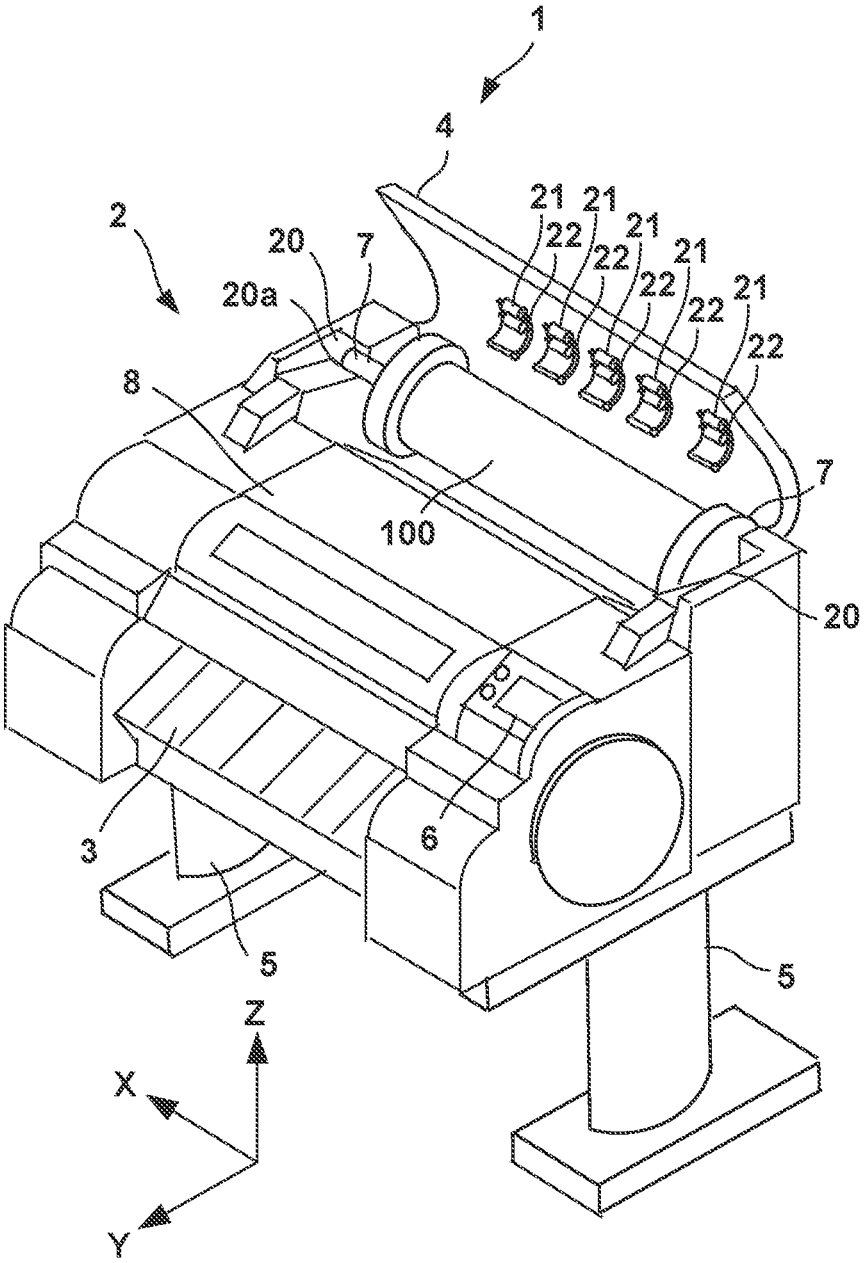
FIG. 1 is an external view of a printing apparatus according to an embodiment of the present invention.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment

<Outline of Printing Apparatus>

Figure 2:
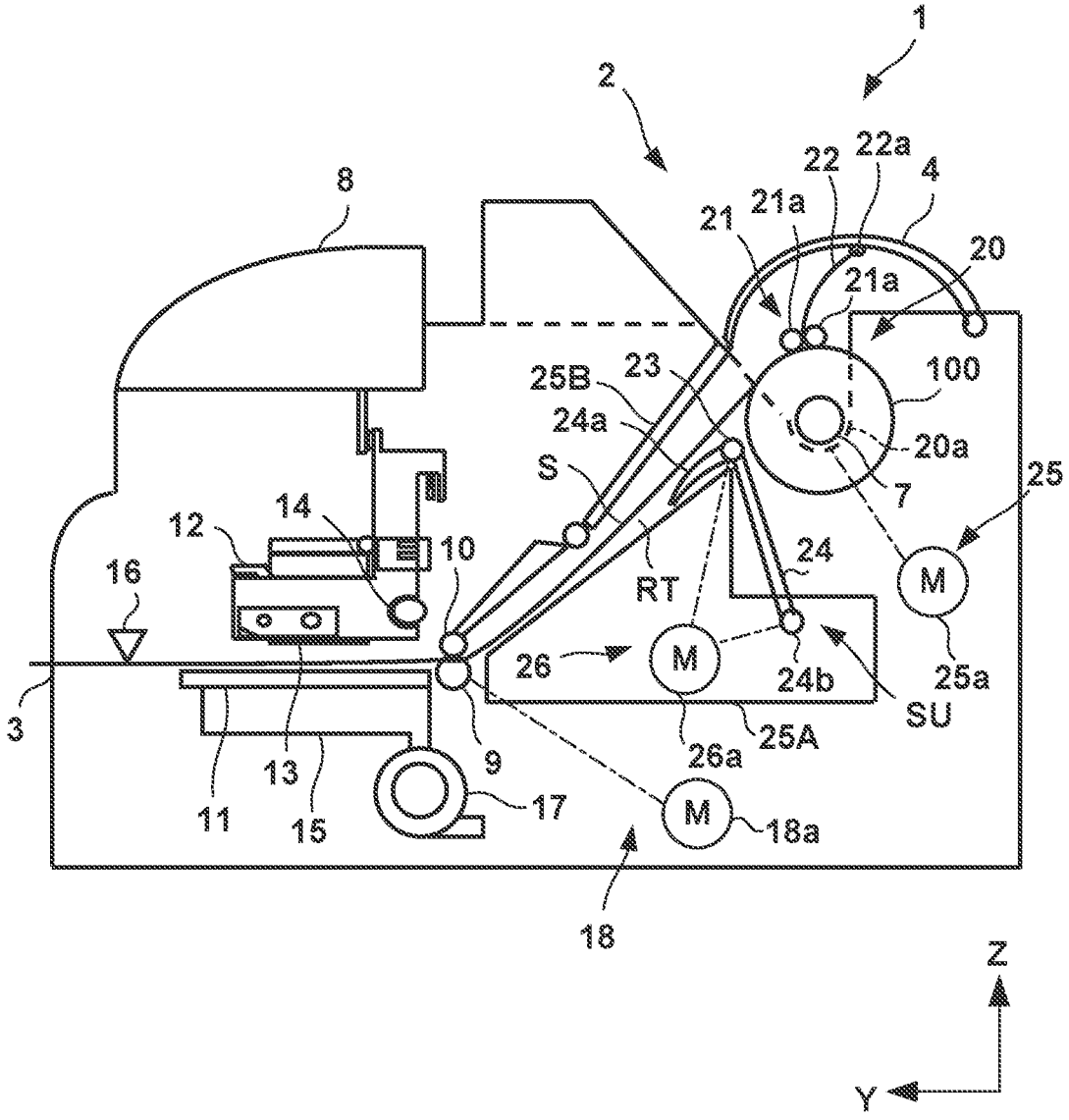
FIG. 2 is a schematic view showing the internal arrangement of the printing apparatus shown in FIG. 1.

FIG. 1 is an external view of a printing apparatus 1 in this embodiment. FIG. 2 is a schematic view showing the internal arrangement of the printing apparatus 1. In the drawings, X indicates the widthwise direction (left-and-right direction) of the printing apparatus 1, Y indicates the depth direction (front-and-rear direction) of the printing apparatus 1, and Z indicates the vertical direction. In this embodiment, a case will be described in which the present invention is applied to a serial inkjet printing apparatus. However, the present invention is applicable to a printing apparatus of another form.

Note that "printing" includes not only forming significant information such as characters and graphics but also forming images, figures, patterns, and the like on print media in a broad sense, or processing print media, regardless of whether the information formed is significant or insignificant or whether the information formed is visualized so that a human can visually perceive it. In addition, although in this embodiment, sheet-like paper is assumed as a "print medium" serving as a print target, sheet-like cloth, plastic film, and the like may be used as print media.

The printing apparatus 1 is supported by a pair of leg portions 5. A feeding apparatus 2 is provided on the far side (rear side) of the printing apparatus 1, and a discharge tray 3 is provided on the near side (front side). An operation panel 6, which is used by the user to input various settings and commands and check information, is provided on the upper surface of the printing apparatus 1. The printing apparatus 1 is an apparatus that can pull out a sheet S from a roll sheet 100 and print an image thereon. The sheet S is one continuous sheet, and the roll sheet 100 is obtained by winding the sheet S into a roll form around a cylindrical core. The roll sheet 100 particularly indicates a roll portion of the sheet S.

The feeding apparatus 2 includes a roll support unit 20 that rotatably supports the roll sheet 100. Holders 7, which define the rotational center axis (X-direction axis) of the roll sheet 100, are detachably attached to both end portions of the roll sheet 100. By setting, in holding portions 20*a*, the roll sheet 100 with the holders 7 attached thereto, the user can perform printing on the roll sheet 100. The roll support unit 20 includes the left and right holding portions 20*a* each of which rotatably supports the spool shaft of the holder 7. Each holding portion 20*a* is a valley-shaped groove, and rotatably supports the shaft portion of the holder 7 in its bottom portion.

The feeding apparatus 2 includes a cover member 4 that covers the roll sheet 100 supported by the roll support unit 20. The cover member 4 is a member having an arc-shaped cross section, and provided so as to be openable/closable between a cover position (for example, the position shown in FIG. 2) where it covers the roll sheet 100 and a retreat position (for example, the position shown in FIG. 1) where it exposes the roll sheet 100 to the outside. The cover member 4 can protect the roll sheet 100 from adhesion of dust, and prevent the user from touching the roll sheet 100 during printing and disturbing the printed image.

The feeding apparatus 2 includes a feeding drive unit 25 that rotates the roll sheet 100 supported by the roll support unit 20 to feed it into a conveyance path RT. The drive unit 25 includes a feeding motor 25*a* as a driving source, and a transmission mechanism such as a gear mechanism that transmits the driving force of the feeding motor 25*a* to the spool gear of the holder 7. By rotating the feeding motor 25*a*, the sheet S of the roll sheet 100 can be fed into the conveyance path RT.

When the roll sheet 100 is set in the roll support unit 20, it is required to introduce the leading edge of the sheet S into the conveyance path RT. The feeding apparatus 2 includes a separation unit SU for separating the leading edge of the sheet S from the peripheral surface of the roll sheet 100 to automatically introduce it into the conveyance path RT. The details of the separation unit SU will be described later.

The conveyance path RT is formed as a space between an upper guide member 25B and a lower guide member 25A. A nip portion between a conveying roller 9 and a driven roller 10 is located in the downstream end of the conveyance path RT. The printing apparatus 1 includes a drive unit 18 that rotates the conveying roller 9. The drive unit 18 includes a conveyance motor 18*a* as a driving source, and a transmission mechanism such as a gear mechanism that transmits the driving force of the conveyance motor 18*a* to the conveying roller 9. By driving the conveyance motor 18*a*, when performing printing, the sheet S is nipped between the conveying roller 9 and the driven roller 10 and, by rotation of these rollers, conveyed onto a platen 11 arranged so as to face a printhead 13.

The platen 11 supports the sheet S from below, and guarantees a gap between the printhead 13 and the sheet S. A plurality of intake holes are formed in the platen 11, and the plurality of intake holes are connected to a suction fan 17 via a duct 15. By driving the suction fan 17, a suction negative pressure is generated in the intake holes of the platen 11, and this enables the sheet S to be chucked and held on the platen 11.

The printhead 13 is mounted on a carriage 12. The carriage 12 is supported such that it can be reciprocated in the X direction (main scanning direction) along a carriage shaft 14 serving as a scanning guide extending in the X direction. The carriage 12 is reciprocated by a drive mechanism which uses a carriage motor 12*a* (FIG. 3) as a driving source.

The printhead 13 is provided with discharge ports (nozzles) that discharge ink. The ink is supplied to the printhead 13 from an ink reservoir (not shown). While the carriage 12 is moved, the ink is discharged from the printhead 13 onto the sheet S. With a discharge operation of the printhead 13 and a move of the carriage 12, an image for one line can be printed. By alternately repeating such image printing and intermittent conveyance of the sheet S by the conveying roller 9 in the Y direction (subscanning direction), an image for one page can be printed. A cutter 16 is arranged on the downstream side of the printhead 13 and the platen 11 in the conveyance direction of the sheet S. The cutter 16 cuts the sheet S in the X direction. Thus, a cut sheet with an image printed thereon can be obtained from the roll sheet 100.

The printing apparatus 1 includes an openable/closable top cover 8. When the top cover 8 is open, the mechanisms around the carriage 12 and the cutter 16 are exposed to the outside, and maintenance thereof can be performed.

<Control Apparatus>

Figure 3:
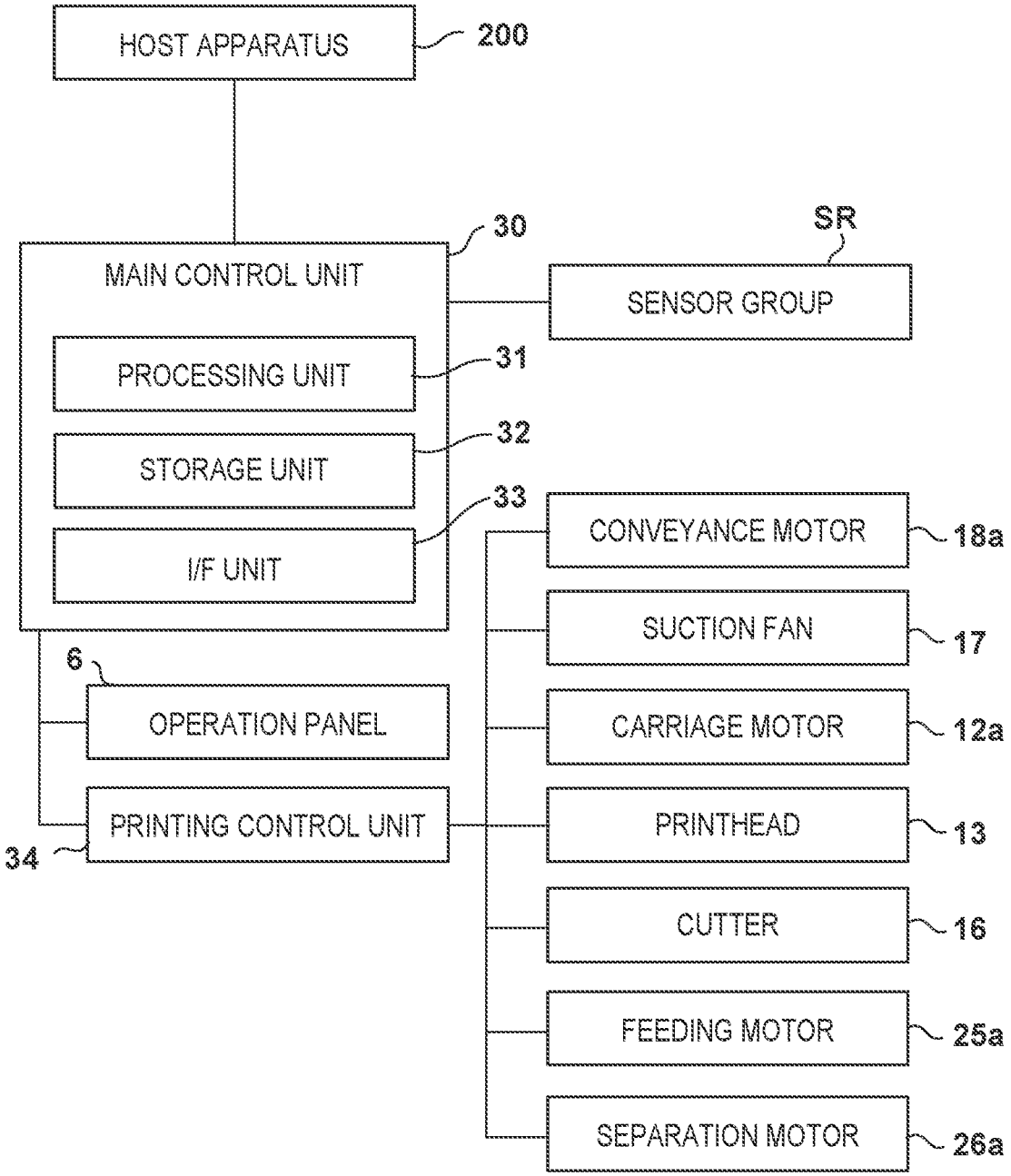
FIG. 3 is a block diagram of a control apparatus of the printing apparatus shown in FIG. 1.

With reference to FIG. 3, a control apparatus of the printing apparatus 1 will be described. The control apparatus includes a main control unit 30 and a printing control unit 34. The main control unit 30 receives image data and a print instruction thereof from a host apparatus 200, and performs a printing operation. The main control unit 30 includes a processing unit 31, a storage unit 32, and an interface unit (I/F unit) 33, and controls the entire printing apparatus 1. The processing unit 31 is a processor represented by a CPU, and executes programs stored in the storage unit 32. The storage unit 32 is a storage device such as a RAM or a ROM, and stores programs and data. By following instructions of the main control unit 30 based on detection results of a sensor group SR, the printing control unit 34 controls the conveyance motor 18*a*, the suction fan 17, the carriage motor 12*a*, the printhead 13, the cutter 16, the feeding motor 25*a*, a separation motor 26*a*, and the like. The sensor group SR includes sensors 19 and 27 and the like to be described later.

<Separation Unit>

Figure 4:
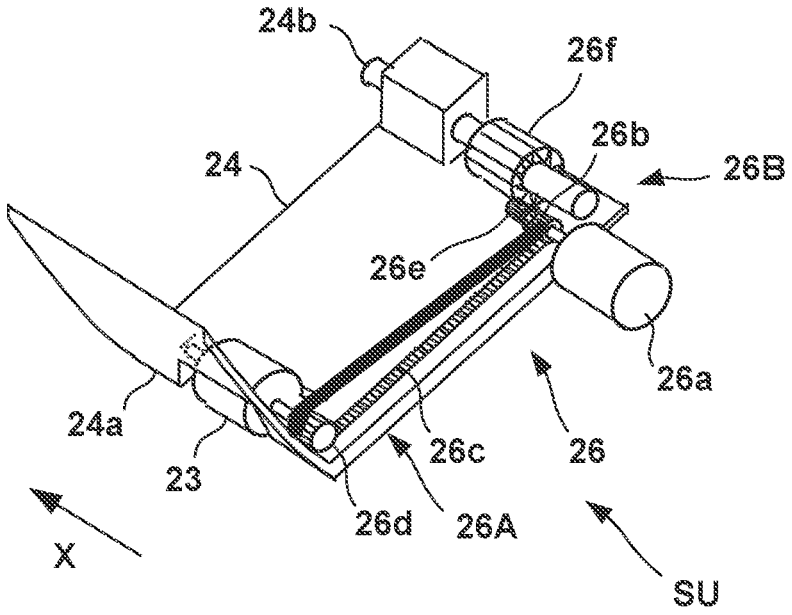
FIG. 4 is a schematic view of a separation unit.

With reference to FIG. 4, the separation unit SU will be described. The separation unit SU includes a rotation member 23, a support member 24 that supports the rotation member 23, and a drive unit 26. The rotation member 23 is supported by the support member 24 so as to be rotatable around the X-direction axis. The rotation member 23 is, for example, a roller whose peripheral surface is covered with rubber, and provided such that it can abut against the outer peripheral surface of the roll sheet 100. When the leading edge of the sheet S is introduced into the conveyance path RT after the roll sheet 100 is set, the rotation member 23 rotates while abutting against the outer peripheral surface of the roll sheet 100, thereby crimping the sheet S and introducing the leading edge of the sheet S into the conveyance path RT.

The support member 24 is an arm member that includes a guide portion 24*a* and the rotation member 23 in one end portion and is supported so as to be pivotable around a pivot shaft 24*b* in the other end portion. The guide portion 24*a* is extended in the direction of the conveyance path RT and, when the leading edge of the sheet S is introduced into the conveyance path RT after the roll sheet 100 is set, guides the sheet to the conveyance path RT. Since the rotation member 23 is adjacent to the guide portion 24*a*, the leading edge of the sheet S wound up by the rotation of the rotation member 23 can be guided by the guide portion 24*a* and more smoothly introduced into the conveyance path RT.

The drive unit 26 includes a drive mechanism 26A that rotates the rotation member 23 and a drive mechanism 26B that causes the support member 24 to pivot. The drive mechanisms 26A and 26B share the separation motor 26*a* serving as a common driving source. The drive mechanism 26A includes a pulley 26*b* fixed to the output shaft of the separation motor 26*a*, a pulley 26*d* fixed to the shaft of the rotation member 23, and a timing belt 26*c* wound around the pulleys 26*b* and 26*d*. By driving the separation motor 26*a*, the rotation member 23 is rotated.

The drive mechanism 26B includes a driving gear 26*e* fixed to the output shaft of the separation motor 26*a*, and a driven gear 26*f* that meshes with the driving gear 26*e*. A torque limiter that interrupts the driving between the driven gear 26*f* and the pivot shaft 24*b* is provided inside the driven gear 26*f* The driven gear 26*f* and the pivot shaft 24*b* pivot integrally if the torque is below the set torque of the torque limiter, and the driven gear 26*f* idles with respect to the pivot shaft 24*b* if the torque is equal to or larger than the set torque. The set torque of the torque limiter is set such that the driven gear 26*f* idles if the torque falls in a range equal to or larger than the maximum torque required for the pivot of the support member 24. By the rotation of the pivot shaft 24*b*, when the support member 24 is caused to pivot from a retreat position to an operating position, which will be described later, the support member 24 pivots until the rotation member 23 is pressed against the roll sheet 100. Thereafter, the driven gear 26*f* idles, and the press-contact state between the rotation member 23 and the roll sheet 100 can be maintained.

<Setting of Roll Sheet>

Figure 5A:
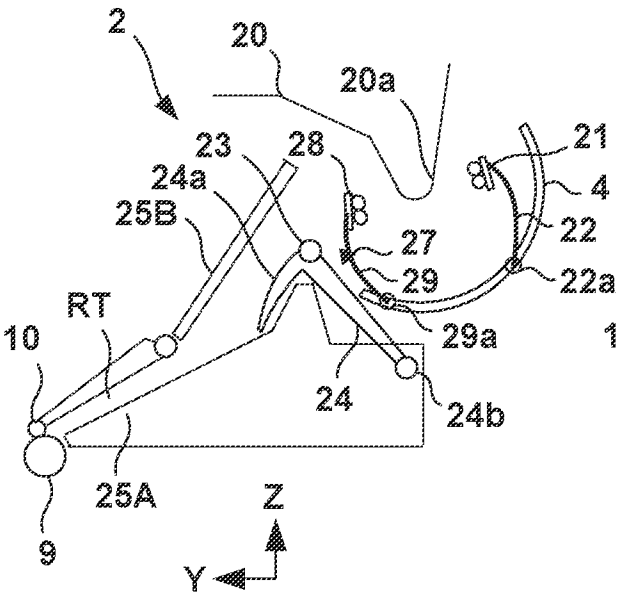
FIGS. 5A to 5C are views for explaining the operation of the feeding apparatus.
Figure 5B:
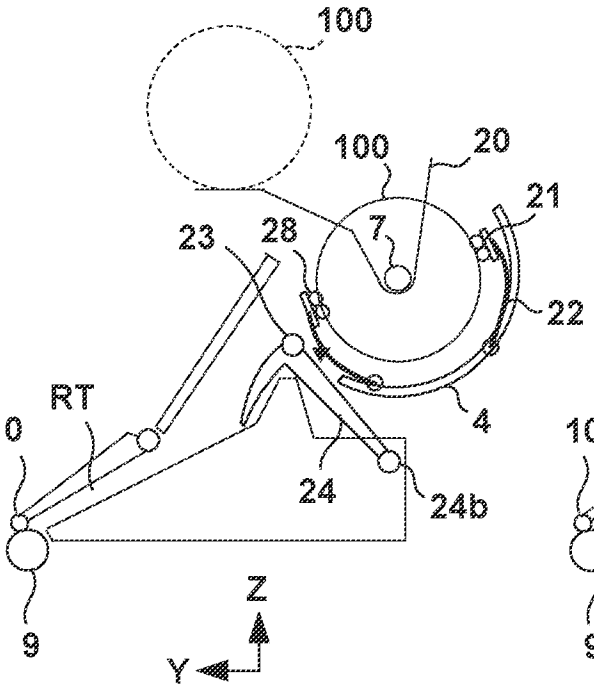
Figure 5C:
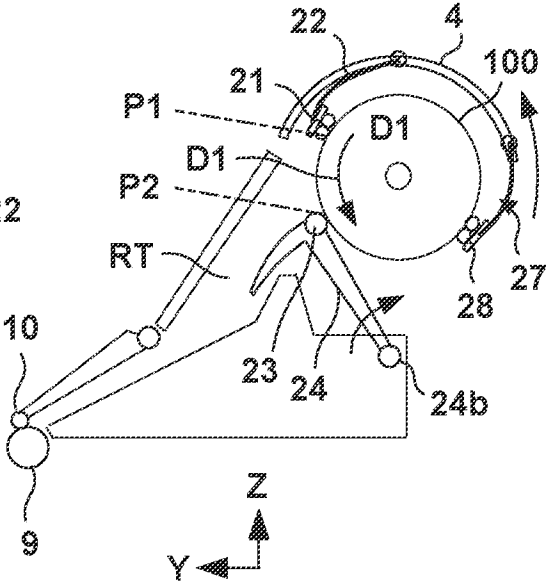

With reference to FIGS. 5A to 5C, a setting operation of the roll sheet 100 by the user and the arrangement of the components of the separation unit SU and the cover member 4 after the setting will be described.

In the cover member 4 according to this embodiment, both end portions thereof in the X direction are pivotably supported by the main body of the printing apparatus, and the pivot center is set at almost the same position as the axial center of the spool shaft bearing of the holding portion 20*a* when viewed in the sectional direction. The cover member 4 can pivot around the pivot center and move between the cover position and the retreat position described above. Each of FIGS. 5A and 5B shows a state in which the cover member 4 is located in the retreat position, and FIG. 5C shows a state in which the cover member 4 is located in the cover position.

When the cover member 4 is located in the retreat position, the user can set the roll sheet 100 in the holding portion 20*a*. In the state shown in FIG. 5A, the user sets the roll sheet 100 in the holding portion 20*a* as shown in FIG. 5B, and moves the cover member 4 to the cover position as shown in FIG. 5C by a manual operation, thereby completing the setting.

On the inner surface of the cover member 4, an abutment portion 21 is supported via an arm member 22. The abutment portion 21 is provided such that it can abut against the outer peripheral surface of the roll sheet 100. In this embodiment, the abutment portion 21 abuts against the outer peripheral surface of the roll sheet 100 when the cover member 4 is located in the cover position as shown in FIG. 5C. The abutment portion 21 and the arm member 22 according to this embodiment form a set, and a plurality of the sets are arranged in the X direction so as to be spaced apart from each other. The abutment portion 21 of each set includes two nip rollers, which are free rotation members, that rotate following the rotation of the roll sheet 100. The two nip rollers are supported by the arm member 22 so as to be rotatable around the X-direction axis, and arrayed in the circumferential direction of the roll sheet 100. Although each abutment portion 21 includes the two nip rollers in this embodiment, it may include one nip roller or may include three or more nip rollers. Further, the abutment portion 21 is not limited to a roller and may be, for example, a ball caster or a pin with a spherical or arc-shaped distal end.

The arm member 22 is supported by the cover member 4 so as to be pivotable around the X-direction axis, and an elastic member 22*a* such as a torsion coil spring is provided in the proximal portion of the arm member 22. The elastic member 22*a* biases the arm member 22 in a direction in which the abutment portion 21 is pressed against the outer peripheral surface of the roll sheet 100. Note that, in order to press the abutment portion 21 against the outer peripheral surface of the roll sheet 100, the arm member 22 may be an elastic member.

In addition, on the inner surface of the cover member 4, an auxiliary portion 28 is supported via an arm member 29. In this embodiment, the arrangements of the auxiliary portion 28 and the arm member 29 are similar to those of the abutment portion 21 and the arm member 22. The arm member 29 is biased by an elastic member 29*a*, and the arrangement of the elastic member 29*a* is similar to that of the elastic member 22*a*. The auxiliary portion 28 is located at a position (a position approximately at an angle of 180°) opposite to the abutment portion 21 in the circumferential direction of the roll sheet 100.

Figure 6B:
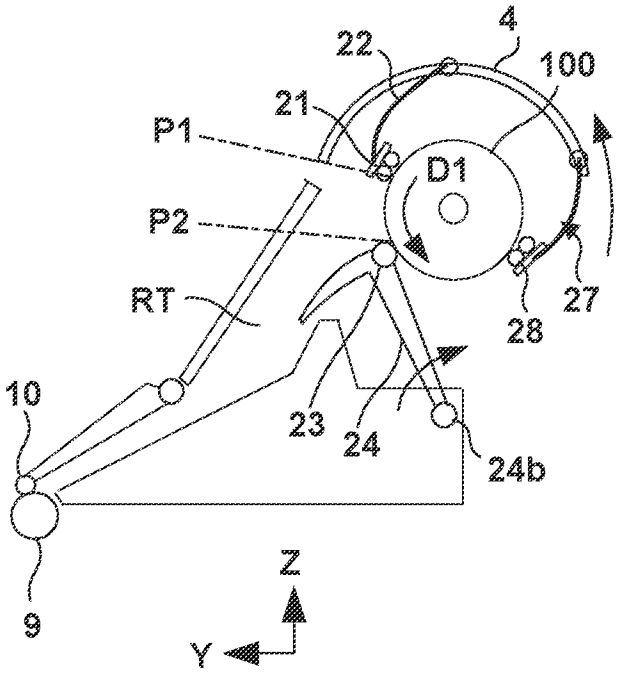
FIGS. 6A and 6B are views for explaining the operation of the feeding apparatus.
Figure 6A:
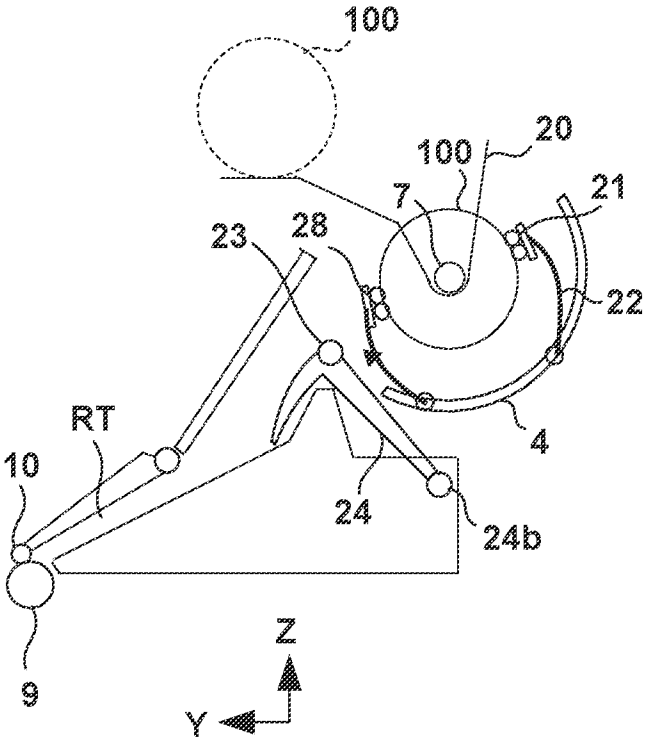

By sandwiching the outer peripheral surface of the roll sheet 100 by the abutment portion 21 and the auxiliary portion 28, it is possible to feed the sheet S more reliably. Each of the arm members 22 and 29 is formed such that it pivots by an angle equal to or larger than the angle capable of coping with a change in winding diameter of the roll sheet 100. Each of FIGS. 5B and 5C shows a state in which the roll sheet 100 of a maximum winding diameter is set in the roll support unit 20, and each of FIGS. 6A and 6B shows a state in which the roll sheet 100 of a minimum winding diameter is set in the roll support unit 20. The abutment portion 21 and the auxiliary portion 28 are formed such that they are pressed against the outer peripheral surface of the roll sheet 100 in either case. It is configured such that the tangent line between the abutment portion 21 and the outer peripheral surface of the roll sheet 100 is directed to the conveyance path RT in both the case shown in FIG. 5C and the case shown in FIG. 6B.

The feeding apparatus 2 includes the sensor 27 that detects the leading edge of the sheet S on the outer peripheral surface of the roll sheet 100. In this embodiment, the sensor 27 is supported by the arm member 29. Since the sensor 27 is supported by the arm member 29, the sensor 27 can detect the leading edge of the sheet S regardless of a change in winding diameter of the roll sheet 100. The sensor 27 is a sensor whose output changes before and after the passage of the edge portion of the sheet S. For example, an optical sensor, a reflection PI sensor, a flag-type PI sensor, or the like can be used as the sensor 27. The optical sensor includes, for example, a light emitting element and a light receiving element. The light emitting element emits light to the outer peripheral surface of the roll sheet 100, and the light receiving element receives the reflected light. The light-receiving amount changes in accordance with the distance between the sensor 27 and the outer peripheral surface of the roll sheet 100. Therefore, the sensor 27 can detect the passage of the edge portion of the sheet S.

The arrangement of the abutment portion 21 and the rotation member 23 will be described. Each of FIGS. 5C and 6B shows a state in which the abutment portion 21 abuts against the outer peripheral surface of the roll sheet 100 and the support member 24 pivots to the working position so that the rotation member 23 abuts against the outer peripheral surface of the roll sheet 100.

The abutment portion 21 abuts against the outer peripheral surface of the roll sheet 100 at a position P1. The position P1 changes slightly in accordance with the winding diameter of the roll sheet 100. The rotation member 23 abuts against the outer peripheral surface of the roll sheet 100 at a position P2. The position P2 also changes slightly in accordance with the winding diameter of the roll sheet 100.

The positions P1 and P2 are set such that the leading edge of the sheet S is introduced into the conveyance path RT by passing between the position P1 and the position P2. In other words, the conveyance path RT is located at a height between the position P1 and the position P2. The positions P1 and P2 are arranged so as to span the entrance of the conveyance path RT. The position P1 is a position (upper position) on one end side of the entrance, and the position P2 is a position (lower position) on the other end side of the entrance. Further, letting D1 be the rotation direction of the roll sheet 100 for feeding the sheet S, the position P2 is set at a position spaced apart from the position P1 in the D1 direction. With the arrangement relationship as described above, as will be described later, when the roll sheet 100 is set, the edge portion of the sheet S is automatically introduced into the conveyance path RT.

<Automatic Introducing Operation>

Figure 8A:
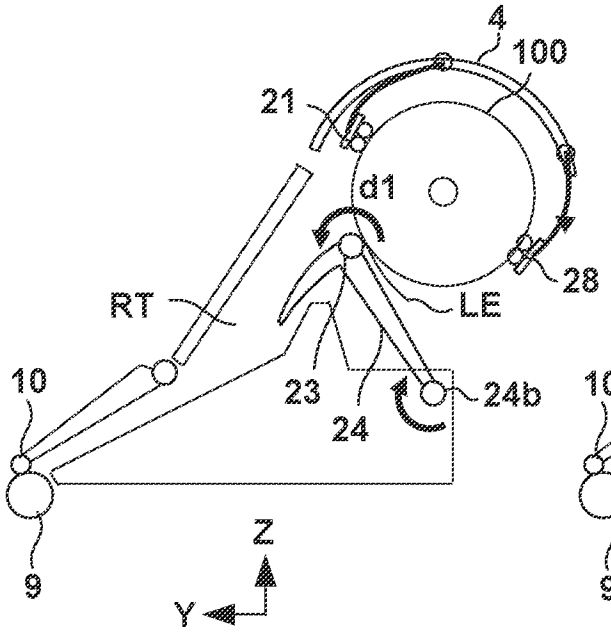
FIGS. 8A to 8C are views for explaining the operation of the feeding apparatus.
Figure 8B:
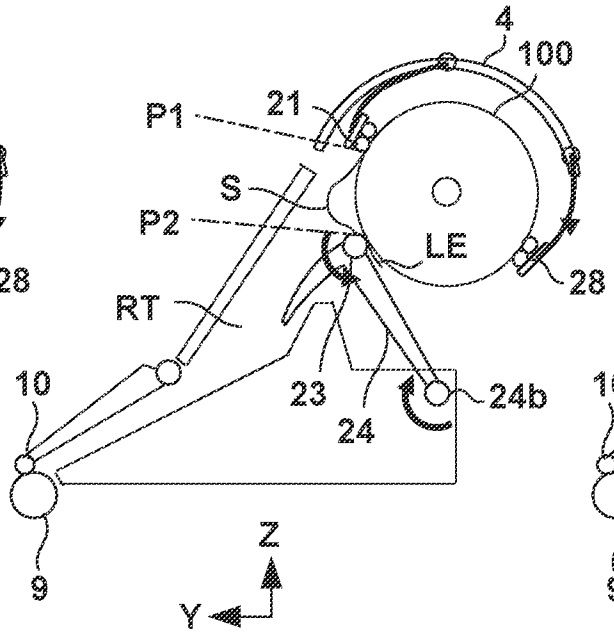
Figure 8C:
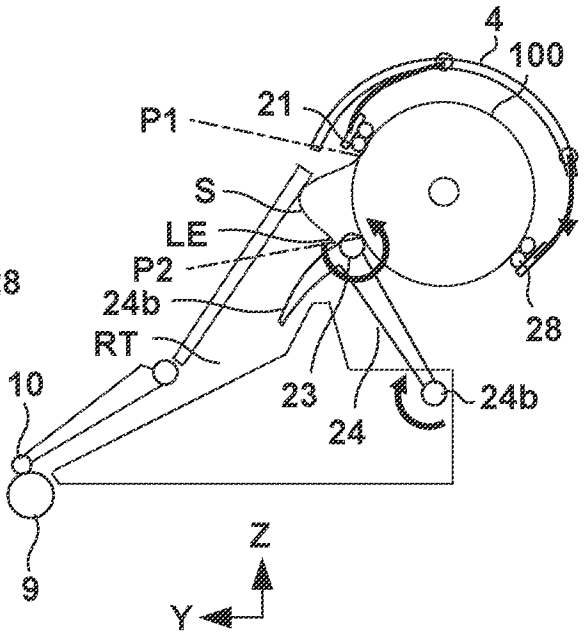
Figure 9A:
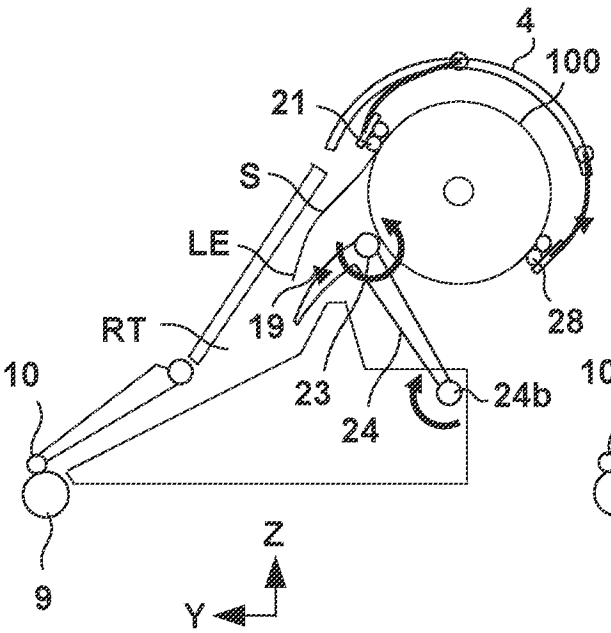
FIGS. 9A to 9C are views for explaining the operation of the feeding apparatus.
Figure 9B:
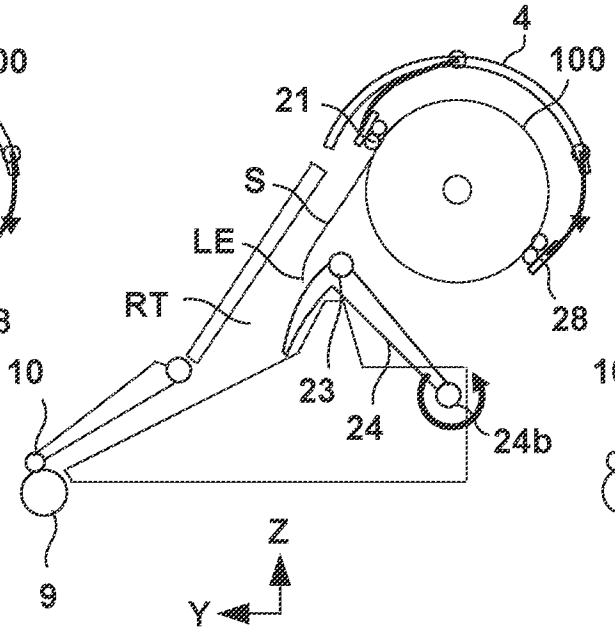
Figure 9C:
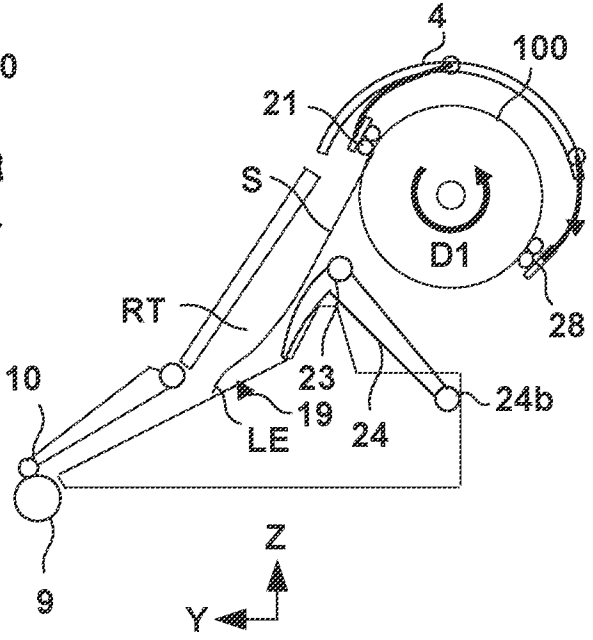
Figure 10:
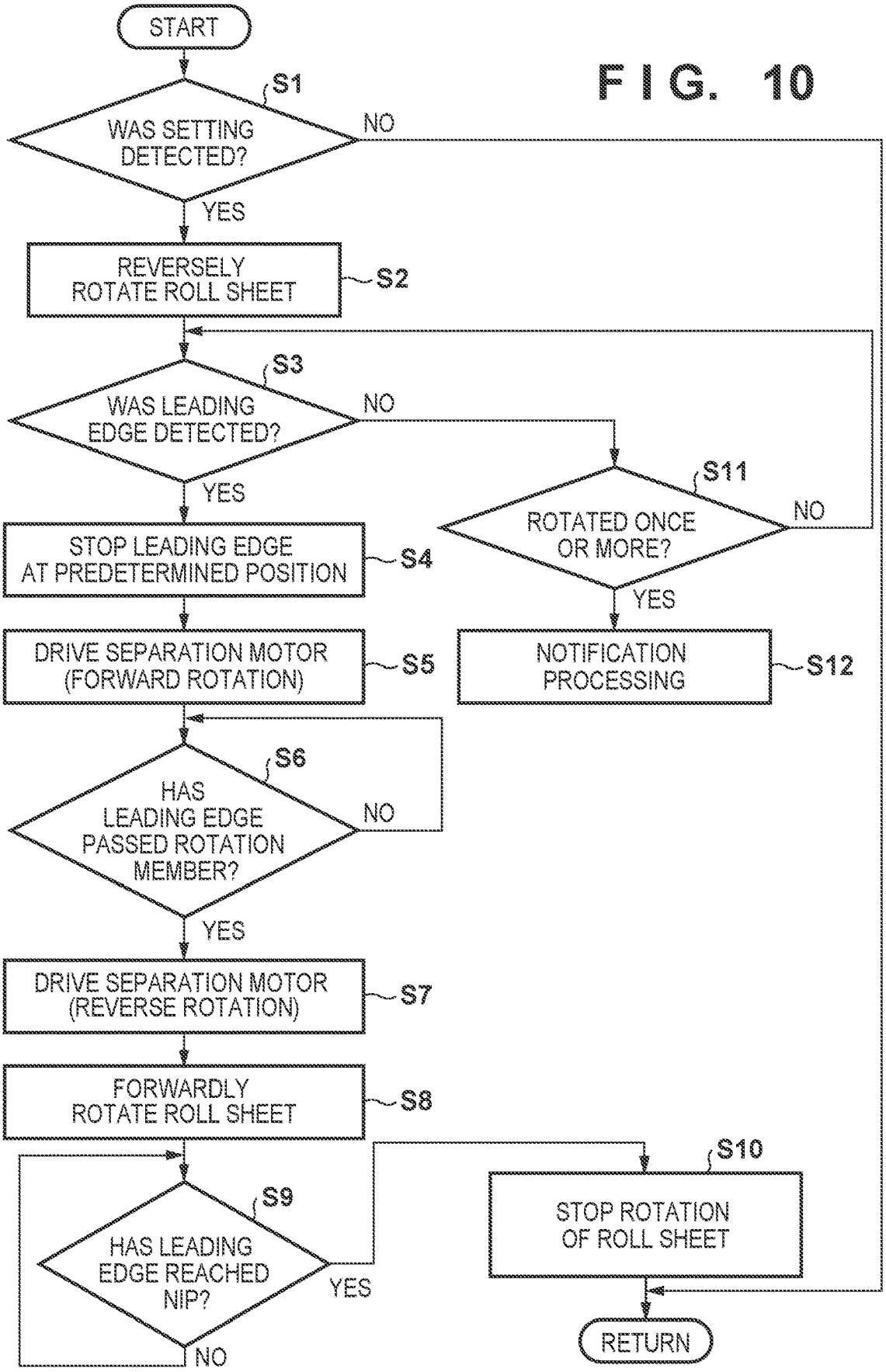
FIG. 10 is a flowchart illustrating an example of control processing of the feeding apparatus.

In this embodiment, when the user sets the roll sheet 100 as shown in each of FIGS. 5C and 6B, an introducing operation is performed in which the leading edge of the sheet S is automatically introduced into the conveyance path RT. FIGS. 7A to 9C show an operational example of the automatic introducing operation. FIG. 10 is a flowchart showing an example of processing of the main control unit 30.

In step S1 of FIG. 10, it is determined whether the roll sheet 100 is set in the roll support unit 20. Setting of the roll sheet 100 can be determined based on a sensor (not shown) or a setting completion operation performed on the operation panel 6 by the user. If it is determined that the roll sheet 100 is set, the processing concerning the automatic introducing operation from step S2 is performed.

Figures 7A, 7B, 7C:
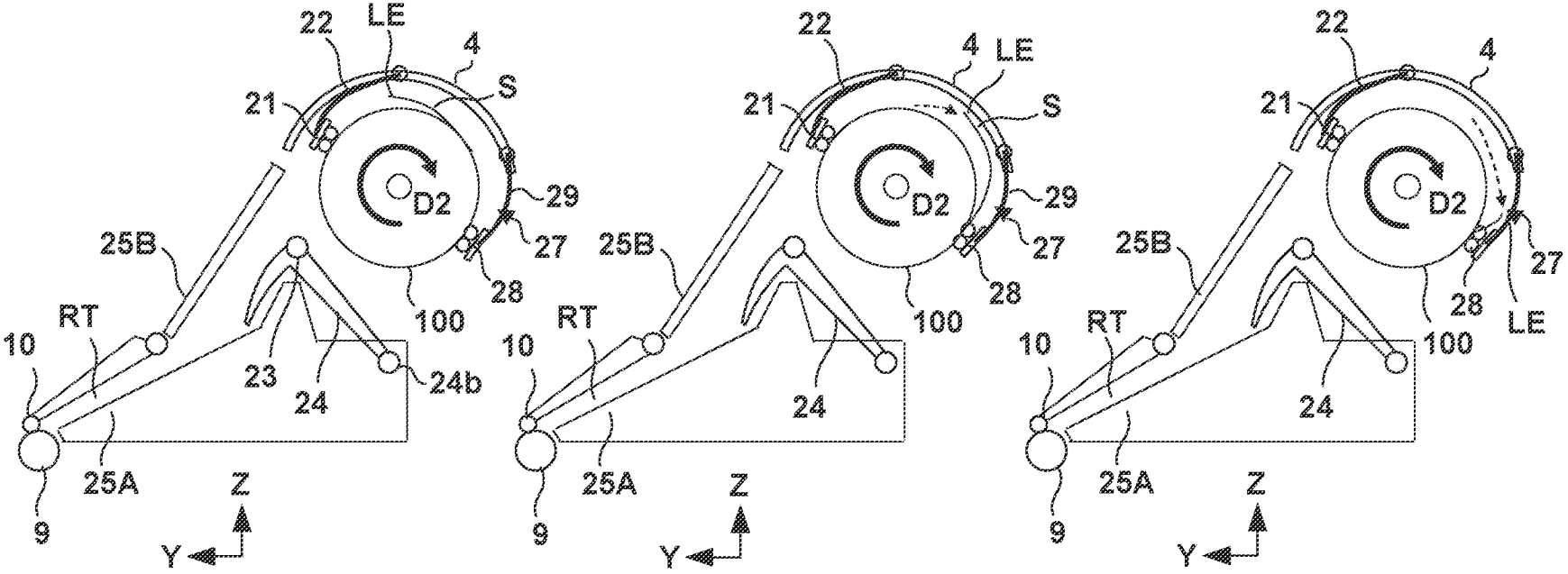
FIGS. 7A to 7C are views for explaining the operation of the feeding apparatus.

In step S2 of FIG. 10, as shown in FIGS. 7A and 7B, the roll sheet 100 is rotated in the D2 direction by the drive unit 25. The D2 direction is a direction (the direction of winding up the sheet S) reverse to the D1 direction. During the rotation of the roll sheet 100, the detection result of the sensor 27 is monitored, and it is determined whether a leading edge LE of the sheet S is detected by the sensor 27 (step S3 of FIG. 10).

By rotating the roll sheet 100 once, the leading edge LE passes the sensor 27. Therefore, if the leading edge LE of the sheet S is not detected by the sensor 27, it is determined in step S11 of FIG. 10 whether the roll sheet 100 has been rotated once. The rotation amount of the roll sheet 100 can be determined from, for example, the rotation amount of the feeding motor 25*a*. If the roll sheet 100 has not been rotated once, the process returns to step S3; otherwise, the process advances to step S12 of FIG. 10.

In step S12 of FIG. 10, since the leading edge LE of the sheet S cannot be detected, a notification is made to prompt the user to manually introduce the sheet. The notification is made by, for example, display on the operation panel 6. Note that as the case in which the leading edge LE cannot be detected, for example, a case in which the roll sheet 100 includes no sheet S and only a core tube is set, or a case in which the leading edge LE is fixed to the outer peripheral surface of the roll sheet 100 with a tape or the like can be assumed.

If the leading edge LE is detected by the sensor 27 as shown in FIG. 7C, the process advances to step S4 of FIG. 10. When the leading edge LE is detected by the sensor 27, the leading edge LE is located at almost the same position as the sensor 27. The distance (angle phase) between the position P2 where the rotation member 23 abuts against the roll sheet 100 and the sensor 27 can be specified. In step S4, the rotation of the roll sheet 100 in the D2 direction is continued until the leading edge LE reaches a position in front of the position P2, and the rotation is stopped. Note that the position in front of the position P2 is only required to be a position that does not exceed the position P2, and accurate positioning is not essential.

In step S5 of FIG. 10, driving of the separation motor 26*a* is started. Here, the separation motor 26*a* is rotated in one direction (this direction is defined as a forward direction). As shown in FIG. 8A, this causes the support member 24 to pivot to the working position, and the rotation member 23 rotates in the dl direction. The support member 24 pivots until the rotation member 23 is pressed against the roll sheet 100. Thereafter, a state in which the rotation member 23 is in press-contact with the outer peripheral surface of the roll sheet 100 is maintained by the action of the torque limiter.

When the rotation member 23 rotates in the dl direction, a force to feed the sheet S in the D2 direction of the roll sheet 100 acts on the sheet S, but the abutment portion 21 abuts against the outer peripheral surface of the roll sheet 100. Accordingly, as shown in FIG. 8B, a slack (loop) of the sheet S is formed between the position P1 and the position P2. As the rotation of the rotation member 23 progresses, as shown in FIG. 8C, the leading edge LE of the sheet S passes the position P2 and comes out between the abutment portion 21 and the rotation member 23. By forming the slack of the sheet S between the position P1 and the position P2, the leading edge LE can be more reliably introduced between the abutment portion 21 and the rotation member 23. That is, the leading edge LE can be more reliably introduced into the conveyance path RT.

In step S6 of FIG. 10, it is determined whether the leading edge LE has passed the rotation member 23. If it is determined that the leading edge LE has passed the rotation member 23, the process advances to step S7; otherwise, the determination in step S6 is repeated. This determination can be made based on the detection result of a sensor provided on the side of the conveyance path RT of the rotation member 23. As one example, FIG. 9A shows an example in which the sensor 19 is arranged in the guide portion 24*a* of the support member 24. The sensor 19 can use a sensor similar to the sensor 27. If the sensor 19 detects the sheet S, it is determined that the leading edge LE has passed the rotation member 23. As another example, if the rotation member 23 has been rotated by a defined amount, it may be considered that the leading edge LE has passed the rotation member 23. The defined amount is only required to be equal to or larger than the rotation amount corresponding to the perimeter of the roll sheet 100 between the position where the leading edge LE is stopped in step S4 and the position P2.

In step S7 of FIG. 10, the separation motor 26*a* is reversely rotated. With this operation, as shown in FIG. 9B, the support member 24 pivots to the retreat position, and the rotation member 23 is separated from the outer peripheral surface of the roll sheet 100. In step S8 of FIG. 10, the roll sheet 100 is rotated in the D1 direction by the drive unit 25 and, as shown in FIG. 9C, the sheet S is fed into the conveyance path RT. In step S9 of FIG. 10, it is determined whether the leading edge LE of the sheet S has reached the nip portion between the conveying roller 9 and the driven roller 10. This determination is made based on the detection result of a sensor (not shown) arranged in the vicinity of the nip portion. If it is determined that the leading edge LE of the sheet S has reached the nip portion, the process advances to step S10, and the rotation of the roll sheet 100 is stopped. Thus, the printing apparatus 1 is set in the printing operation standby state.

Note that in this embodiment, control for locating the leading edge LE of the sheet S at the predetermined position by rotating the roll sheet 100 in the D2 direction is performed in steps S2 to S4 of FIG. 10. However, the processing in step S5 may be performed while omitting the processing in steps S2 to S4. In this case, the rotation amount of the rotation member 23 may be an amount corresponding to one rotation of the roll sheet 100. The perimeter on the outer peripheral surface of the roll sheet 100 changes in accordance with the winding diameter, but the defined amount may be the amount corresponding to the perimeter of the roll sheet 100 of the maximum winding diameter. Alternatively, in this case, the rotation member 23 may be rotated until the leading edge LE of the sheet S is detected by the sensor 19 (FIG. 9A).

Second Embodiment

Figure 11A:
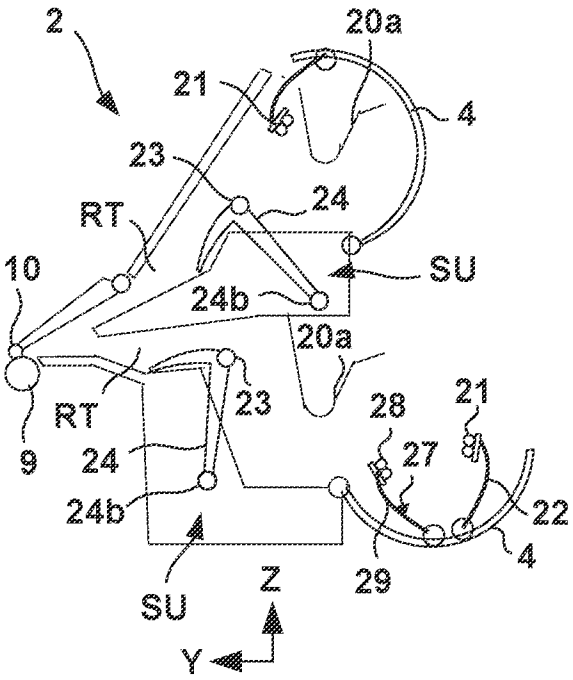
FIGS. 11A to 11C are views for explaining another feeding apparatus.
Figure 11B:
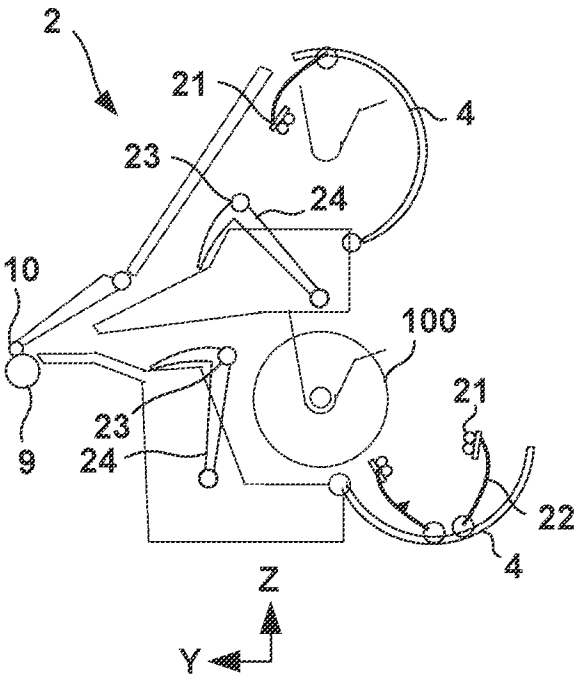

A feeding apparatus 2 may be configured such that roll sheets 100 can be set in two upper and lower stages and a conveyance path RT may be located above the rotation center of the roll sheet 100. FIG. 11A shows one example. In the illustrated example, a cover member 4, a separation unit SU, and the like are arranged in each of the upper stage and the lower stage, and the conveyance path RT is bifurcated on the upstream side. FIG. 11B shows a state in which the roll sheet 100 is set in a holding portion 20*a* of the lower stage. The rotation center of the roll sheet 100 is located lower than the conveyance path RT.

Figure 11C:
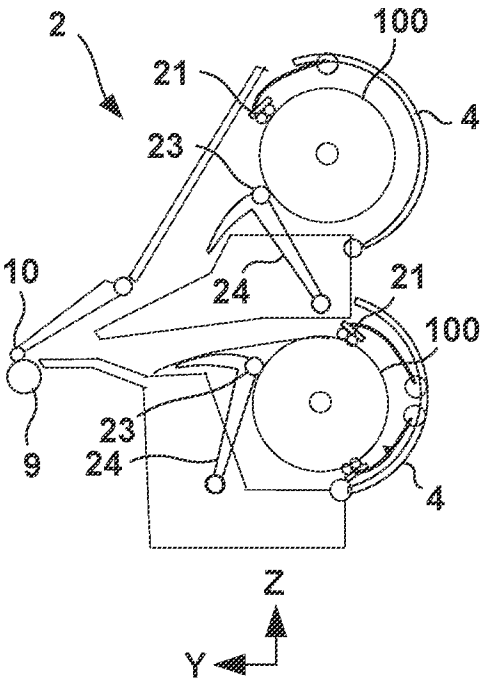
Figure 12B:
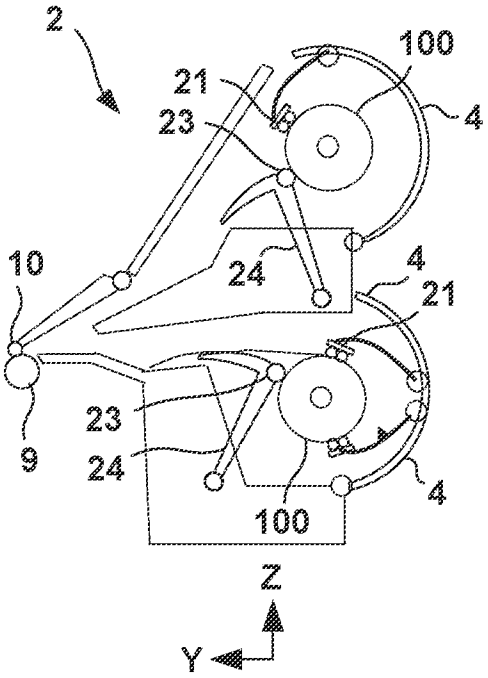
FIGS. 12A and 12B are views for explaining the other feeding apparatus.
Figure 12A:
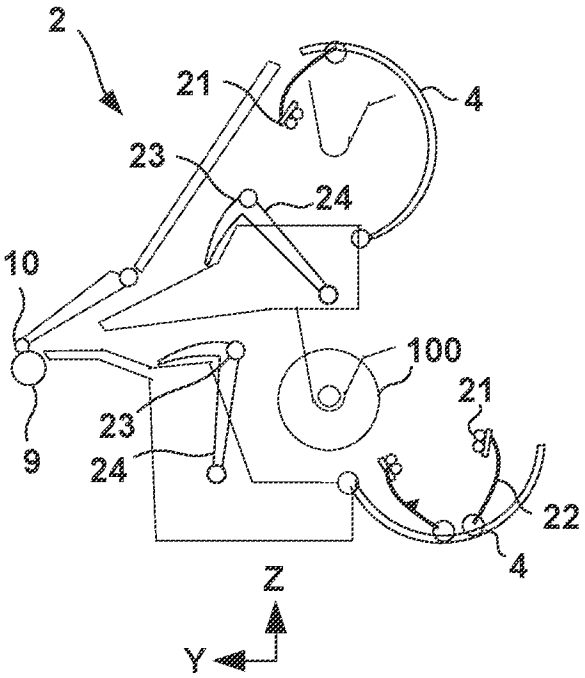

FIG. 11C shows a state in which an automatic introducing operation of the roll sheet 100 in the lower stage has been performed. A leading edge LE of a sheet S can be automatically introduced on the principle similar to that in the first embodiment. Although not particularly shown, this also applies to the upper stage. FIGS. 12A and 12B show an example in which the roll sheet 100 of a small winding diameter is set in the lower stage. Also in this case, the leading edge LE of the sheet S can be automatically introduced on the principle similar to that in the first embodiment.

Third Embodiment

In general, if the rigidity of a sheet S is low in a feeding operation, a feeding error of the sheet S may occur. In this embodiment, if a support member 24 is located at a position biased in the X direction with respect to the sheet S, curling or the like may occur on the opposite side of the sheet S, and automatic introduction may not be performed successfully. Each of FIGS. 13A and 13B shows an example.

Figure 13A:
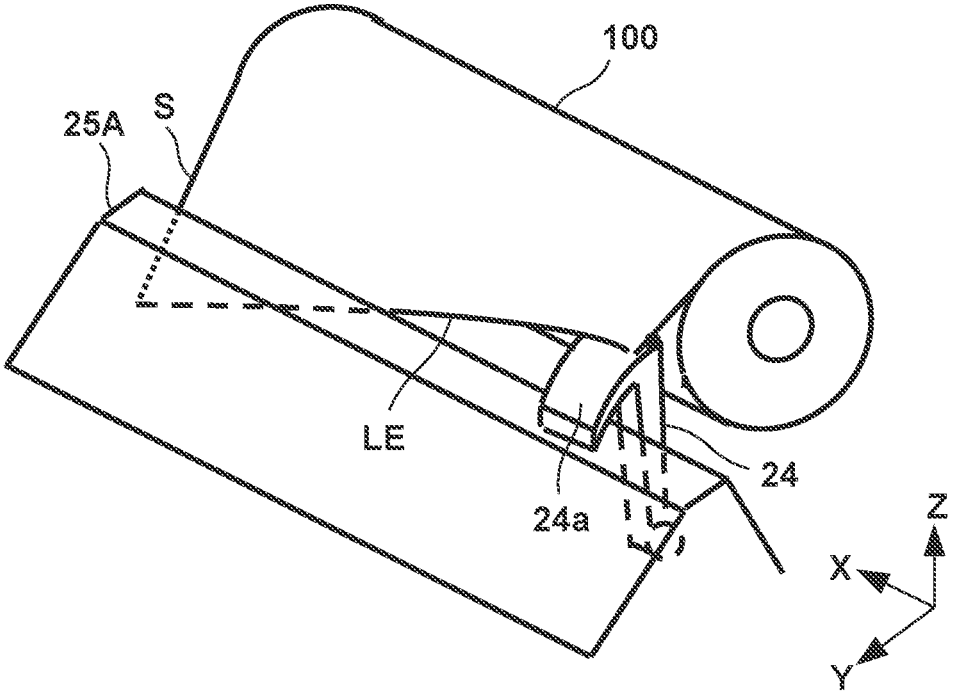
FIGS. 13A and 13B are views each for explaining a feeding error.
Figure 13B:
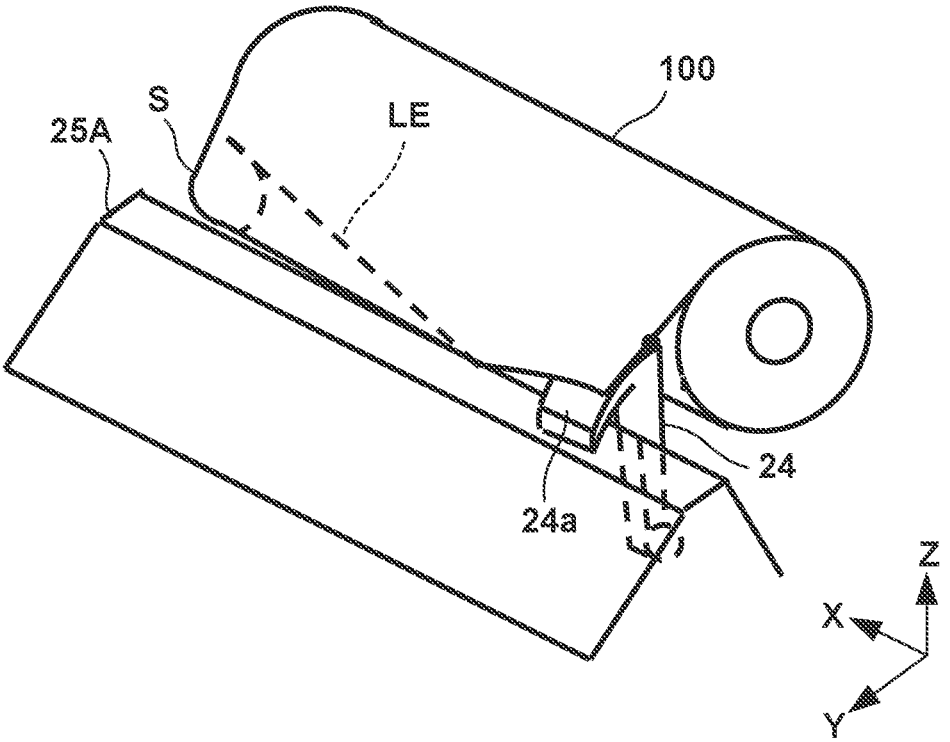

Each of FIGS. 13A and 13B shows an arrangement example in which the support member 24 is located in an end portion of the sheet S in the widthwise direction. If the rigidity of the sheet S is low, a leading edge LE may hang down due to its own weight. Of the sheet S, a portion landing on a guide portion 24*a* is supported by the guide portion 24*a*, but an opposite portion is not supported so that it hangs down or curls. The leading edge LE does not land on a guide member 25A, and if the roll sheet 100 is rotated in this state, a jam occurs.

Figure 14A:
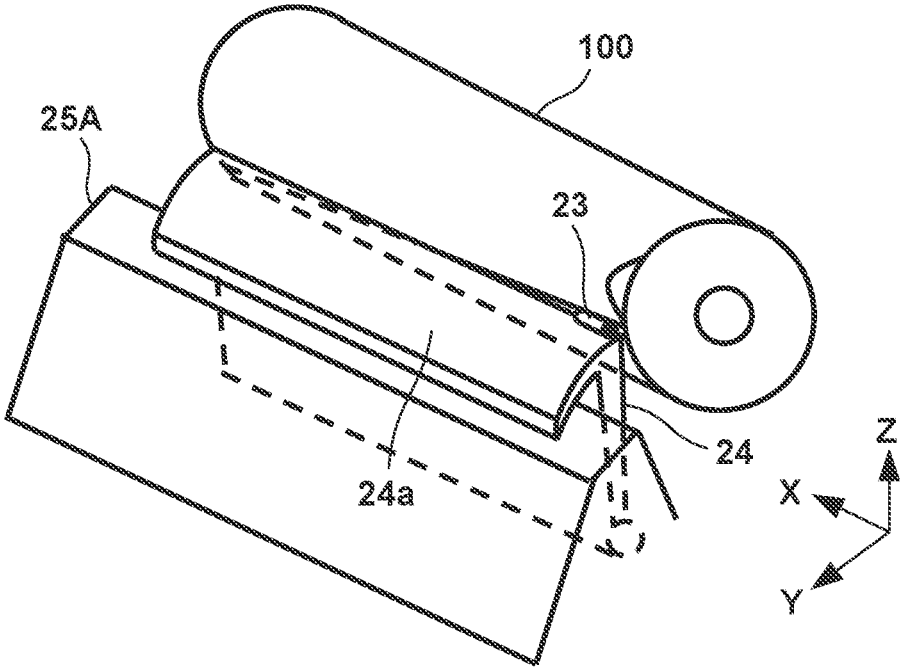
FIGS. 14A and 14B are views for explaining a structure that eliminates a feeding error.
Figure 14B:
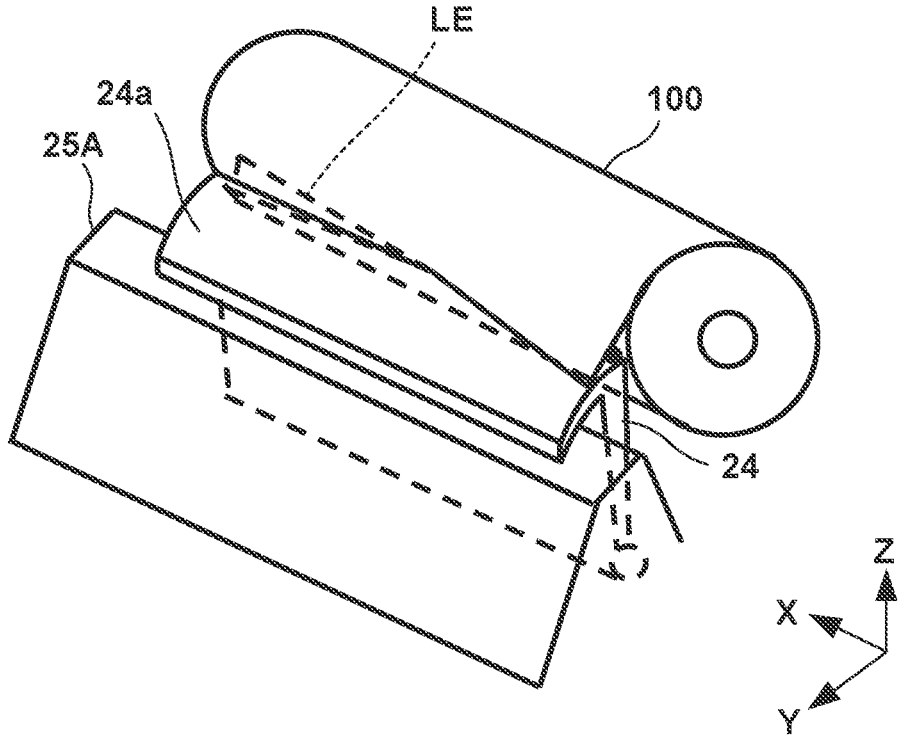

As a measure to this, FIGS. 14A and 14B shows an arrangement in which the guide portion 24*a* of the support member 24 is extended in the X direction so that it can support the sheet S in almost the whole width. A rotation member 23 is supported at a position on the guide portion 24*a* biased in the widthwise direction (X direction) of the sheet S. In the illustrated example, the rotation member 23 is particularly supported in one end portion of the guide portion 24*a* in the X direction. This has a certain effect in improving the feeding error illustrated in each of FIGS. 13A and 13B. However, since the rotation member 23 is located at the position biased in the X direction, there is a possibility of occurrence of a jam.

That is, during automatic introduction, the leading edge LE of the sheet S on one end side in the X direction where the rotation member 23 is located lands on the guide portion 24*a*, but the sheet S on the other end side, where no rotation member 23 is provided, may not land on the guide portion 24*a* but buckle in front of the guide portion 24*a*. If the roll sheet 100 is rotated in this state, a jam occurs.

As a measure to this, a long roller extended in the whole area in the X direction to the other end side may be used as the rotation member 23, or a plurality of the rotation members 23 may be provided in the X direction so as to be spaced apart from each other. This can suppress occurrence of a jam.

Figure 15A:
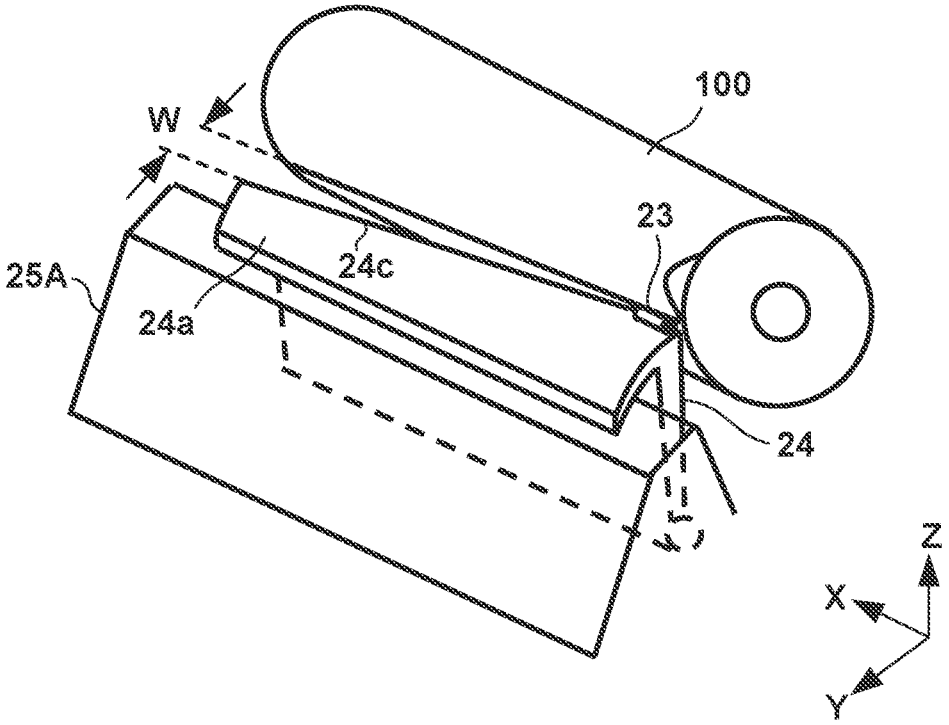
FIGS. 15A and 15B are views for explaining another structure that eliminates a feeding error.
Figure 15B:
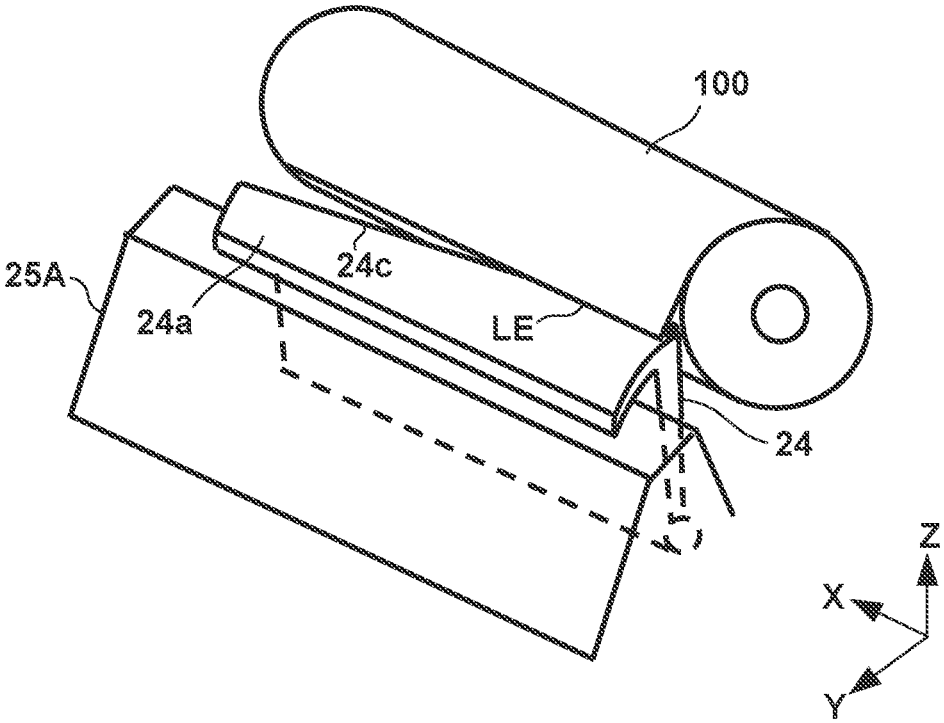
Figure 16A:
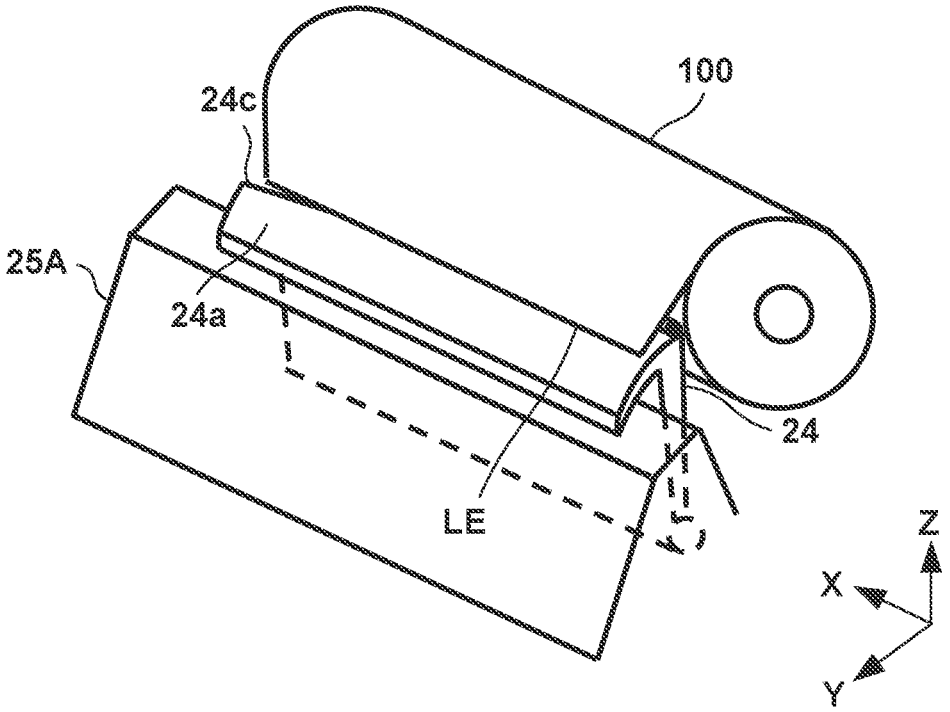
FIGS. 16A and 16B are views for explaining the other structure that eliminates a feeding error.
Figure 16B:
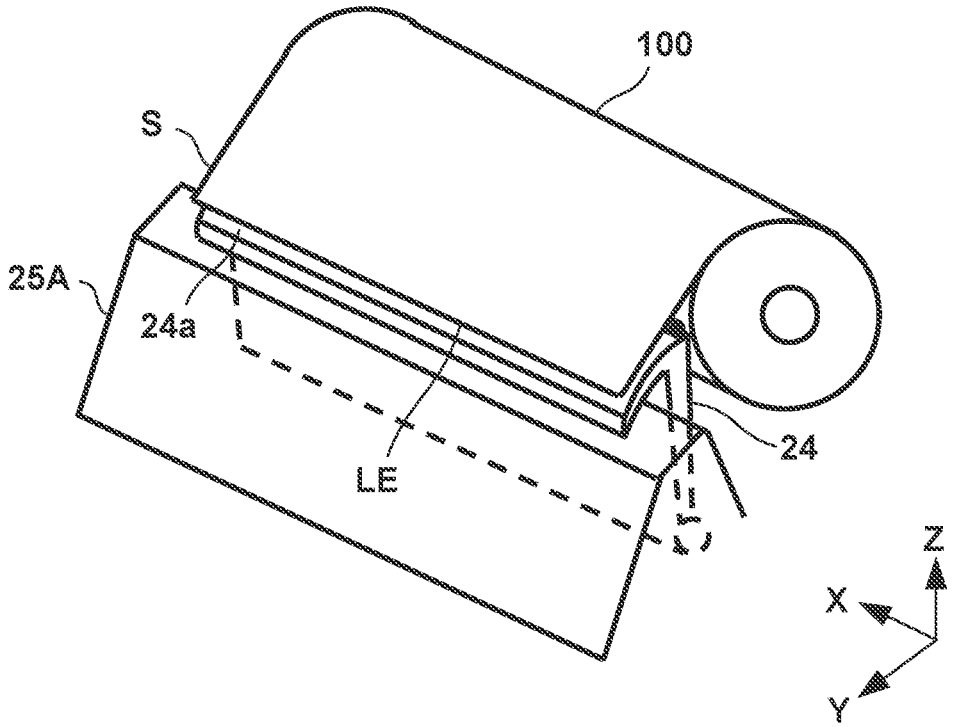

As another measure, as shown in FIG. 15A, an end portion 24*c* of the guide portion 24*a* on the roll-sheet side may be inclined in the X direction from the side close to the rotation member 23 toward the side far from the rotation member 23 so as to be separated from the roll sheet 100. In the illustrated example, compared to the side near the rotation member 23, the end portion 24*c* on the opposite side in the X direction is separated from the outer peripheral surface of the roll sheet 100 by a distance W. In addition, the surface of the guide portion 24*a* may be a surface twisted in the X direction from the end portion on the side of the rotation member 23 toward the end portion on the opposite side.

The behavior of the sheet S is shown in FIGS. 15B to 16B. Since the end portion 24*c* is inclined, after one end portion of the sheet S in the widthwise direction is crimped by the rotation member 23 and placed on the guide portion 24*a*, the leading edge LE is scooped up by the guide portion 24*a* and placed thereon toward the other end portion of the sheet S in the widthwise direction. This can suppress occurrence of a jam.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-043332, filed Mar. 12, 2020, which is hereby incorporated by reference herein in its entirety.

What is claimed is:

1. A feeding apparatus comprising a roll support unit configured to rotatably support a roll sheet which is a sheet wound into a roll form;

a first drive unit configured to rotate the roll sheet supported by the roll support unit in a predetermined rotation direction to feed the sheet into a conveyance path;

an abutment portion provided so as to be capable of abutting against an outer peripheral surface of the roll sheet at a first position;

a rotation member provided so as to be capable of abutting against the outer peripheral surface at a second position different from the first position; and a second drive unit, wherein the first drive unit rotates the roll sheet in the predetermined rotation direction to introduce, into the conveyance path, a leading edge of the sheet having passed between the first position and the second position, and the second drive unit is configured to rotate the rotation member in a direction in which a slack of the sheet is formed between the first position and the second position.

2. The apparatus according to claim 1, wherein the first position and the second position are set such that the leading edge of the sheet is introduced into the conveyance path by passing between the first position and the second position, and the second position is set at a position spaced apart from the first position in the predetermined rotation direction, and when the leading edge of the sheet is introduced into the conveyance path, the second drive unit rotates the rotation member in the direction, in which the slack of the sheet is formed between the first position and the second position, until the leading edge passes the second position.

3. The apparatus according to claim 1, wherein the abutment portion includes at least one free rotation member configured to rotate following rotation of the roll sheet.

4. The apparatus according to claim 1, wherein when the leading edge of the sheet is introduced into the conveyance path, the second drive unit rotates the rotation member by an amount corresponding to one rotation of the roll sheet.

5. The apparatus according to claim 1, further comprising:

a detection unit configured to detect that the leading edge of the sheet has passed the second position, wherein the second drive unit stops rotation of the rotation member based on a detection result of the detection unit.

6. The apparatus according to claim 1, further comprising:

a detection unit configured to detect the leading edge on the outer peripheral surface of the roll sheet before the leading edge of the sheet is introduced into the conveyance path, wherein based on a detection result of the detection unit, the first drive unit rotates the roll sheet such that the leading edge is located at a position spaced apart from the second position in the predetermined rotation direction.

7. The apparatus according to claim 1, further comprising:

a support member configured to support the rotation member, wherein the support member includes a guide portion configured to guide the sheet to the conveyance path, and the rotation member is supported at one end of the guide portion on a side of the roll sheet.

8. The apparatus according to claim 7, wherein the rotation member is supported at a position on the guide portion biased in a widthwise direction of the sheet, and the end portion of the guide portion on the side of the roll sheet is inclined in the widthwise direction from a side close to the rotation member toward a side far from the rotation member so as to be separated from the roll sheet.

9. The apparatus according to claim 7, wherein the support member includes a third drive unit configured to cause a pivot to a working position where the rotation member abuts against the outer peripheral surface of the roll sheet and a pivot to a retreat position where the rotation member is separated from the outer peripheral surface of the roll sheet, wherein the third drive unit causes the support member to pivot from the retreat position to the working position when the leading edge of the sheet is introduced into the conveyance path, and causes the support member to pivot from the working position to the retreat position after the leading edge has been introduced into the conveyance path.

10. The apparatus according to claim 9, wherein the second drive unit and the third drive unit include a motor as a common driving source, if the motor is rotated in one direction, the support member pivots to the working position and the rotation member rotates in the direction in which the slack of the sheet is formed, and if the motor is rotated in a reverse direction, the support member pivots to the retreat position.

11. The apparatus according to claim 1, further comprising:

a cover member configured to cover the roll sheet supported by the roll support unit, wherein the abutment portion is supported by the cover member via an arm member, and biased to the outer peripheral surface of the roll sheet by an elastic member.

12. The apparatus according to claim 1, wherein the abutment portion is located at a position higher than the rotation member, and an entrance of the conveyance path is located at a height between the abutment portion and the rotation member.

13. A printing apparatus comprising:

a feeding apparatus; and a printing unit configured to print an image on a sheet fed from the feeding apparatus, wherein the feeding apparatus comprises:

a roll support unit configured to rotatably support a roll sheet, which is a sheet wound into a roll form, a first drive unit configured to rotate the roll sheet supported by the roll support unit in a predetermined rotation direction to feed the sheet into a conveyance path, an abutment portion provided so as to be capable of abutting against an outer peripheral surface of the roll sheet at a first position, a rotation member provided so as to be capable of abutting against the outer peripheral surface at a second position different from the first position, and a second drive unit, the feeding apparatus causes the first drive unit to rotate the roll sheet in the predetermined rotation direction to introduce, into the conveyance path, a leading edge of the sheet having passed between the first position and the second position, and the second drive unit is configured to rotate the rotation member in a direction in which a slack of the sheet is formed between the first position and the second position.

14. A control method of a feeding apparatus that includes a first drive unit configured to rotate a roll sheet in a predetermined rotation direction to feed the sheet into a conveyance path, an abutment portion provided so as to be capable of abutting against an outer peripheral surface of the roll sheet at a first position, a rotation member provided so as to be capable of abutting against the outer peripheral surface at a second position different from the first position, and a second drive unit, the method causing the first drive unit to rotate the roll sheet in the predetermined rotation direction to introduce, into the conveyance path, a leading edge of the sheet having passed between the first position and the second position, the method comprising:

causing the second drive unit to rotate the rotation member in a direction in which a slack of the sheet is formed between the first position and the second position; and stopping the rotation of the rotation member by the second drive unit after the leading edge has passed the second position.

* * * * *